US006019044A

United States Patent [19]

Bertrand

[11] Patent Number: 6,019,044

[45] Date of Patent: Feb. 1, 2000

[54] MAINTENANCE SYSTEM FOR A POSTAGE METER

[75] Inventor: Guy Bertrand, Sceaux, France

[73] Assignee: Neopost Industrie, Bagneux, France

[21] Appl. No.: 09/195,995

[22] Filed: Nov. 20, 1998

[30] Foreign Application Priority Data

Nov. 20, 1997 [FR] France ..... 97 14562

[51] Int. Cl.[7] ..... B41F 35/00

[52] U.S. Cl. ..... 101/425; 101/91; 101/423

[58] Field of Search ..... 101/91, 99, 93, 101/110, 425, 483, 423; 15/256.5, 256.51, 256.52, 256.53

[56] References Cited

U.S. PATENT DOCUMENTS

| | | | |
|---|---|---|---|
| 3,187,670 | 6/1965 | Jennings et al. | 101/425 |
| 3,467,011 | 9/1969 | Phleps et al. | 101/425 |
| 3,898,929 | 8/1975 | Arild et al. | 101/147 |
| 4,673,303 | 6/1987 | Sansone et al. | 101/425 |
| 5,188,025 | 2/1993 | Murphy, III et al. | 101/91 |
| 5,390,602 | 2/1995 | Gorl | 101/425 |
| 5,778,347 | 7/1998 | Hetzer | 101/425 |
| 5,784,963 | 7/1998 | Schmid | 101/425 |

OTHER PUBLICATIONS

IBM Technical Disclosure Bulletin, Balles, Jr. "Type Wheel Cleaner" vol. 18, No. 8, Jan. 1976.

*Primary Examiner*—Christopher A. Bennett
*Attorney, Agent, or Firm*—Sughrue, Mion, Zinn, Macpeak & Seas, PLLC

[57] ABSTRACT

In a print head of a postage meter of the type having a rotary drum, said print head being provided with a set of engraved printing surfaces, which set has at least first print wheels for printing a postage value and second print wheels for printing a current date, and said postage meter including an inking support on which an inking roller is mounted for the purpose of inking the print head, firstly the inking roller is replaced with the cleaning roller, then the motor of the print head is actuated for a determined duration, and, at the end of said determined duration, the inking roller is put back into place after the cleaning roller has been removed. The invention also relates to a a corresponding cleaning system, and to a postage meter incorporating such a system.

15 Claims, 2 Drawing Sheets

MAINTENANCE SYSTEM FOR A POSTAGE METER

FIELD OF THE INVENTION

The present invention relates to a maintenance system for a postage meter or "franking machine", it relates more particularly to a method of cleaning the print head of a postage meter of the type having a rotary drum.

PRIOR ART

The problem of obtaining good printing quality with the print head of a postage meter is an essential problem in the field of mail handling in which the postage imprint that is printed represents a monetary value. In postage meters of the rotary drum type, the rotary engraved printing surfaces formed by the plates (stamp, advertising), and by the print wheels (date, value) of the print head are exposed to air, and the ink that is deposited prior to printing and that is not fully transferred to the item to be printed can then dry. Furthermore, the dried residual ink combined with deposits of dust and of paper residue coming from the item to be printed clogs up the print wheels, and, after a certain number of print cycles, can cause them to jam, thereby preventing the postage meter from operating at all.

Currently, when the printing of a postage imprint becomes defective, or, in extreme cases, when the print wheels jam, the user of the postage meter calls on the after-sales service and they clean the corresponding print head. However, once the print head has been cleaned, it must be returned to the postal authorities. In the field of mail franking, the print head which incorporates the accounts registers is made secure by physical means and by software, and its being put back into service after work has been done on it internally (such as cleaning) is subject to authorization from the postal authorities, so as to avoid any attempts to tamper with it.

In an attempt to make it unnecessary to return the meter to the postal authorities, U.S. Pat. No. 5,188,025 proposes a device for cleaning a print head, that device being suitable for a postage meter of the flat-plate type, and comprising a hinged mechanism on which a brush is mounted facing the print plate. Two rows of bristles are provided to remove any fibrous residue that remains deposited in the print plate after it has been used, and that, mixed with the film of ink, would otherwise degrade the printing quality of the postage imprint.

It might be thought that that solution could be applied to postage meters of the rotary drum type. However, that brushing solution would then be unsuitable because it would not prevent the ink from drying, nor would it prevent the print wheels from clogging up. Indeed, since that type of product inevitably sheds bristles, it would merely accelerate such clogging.

OBJECT AND DEFINITION OF THE INVENTION

An object of the present invention is to clean the engraved printing surfaces of the print head thoroughly rather than merely brushing them. To this end, the present invention provides a cleaning method to be implemented by the after-sales maintenance service of the postage meter, said method being characterized in that firstly the inking roller of the postage meter is replaced with a cleaning roller, then the motor of the print head is actuated for a determined duration, and, at the end of said determined duration, the inking roller is put back into place after the cleaning roller has been removed.

The actuation of the motor of the print head for a determined duration comprises rotating the print head through a predetermined number of revolutions, e.g. fifty. Preferably, the print head is rotated while each of the print wheels of the head is positioned at a reference value, and, after the print head has been rotated, each of the print wheels can be rotated in succession, with the print head remaining stationary.

Thus, with the method of the invention, the cleaning roller distributes solvent uniformly over the print wheels or over the print plates, and, by rotating each wheel, it is also possible to improve the distribution of the solvent in the gaps between the wheels.

Each of the print wheels is rotated in turn for a predetermined duration, e.g. five seconds.

In a variant implementation, at the end of the determined duration for which the motor of the print head is actuated, instead of putting the inking roller back into place, the cleaning roller is replaced with a drying roller, and the print head is then rotated through a predetermined number of revolutions, the inking roller being put back into place only after this further rotation of the print head.

Advantageously, the cleaning roller is made of a polyurethane foam pre-impregnated with a cleaning solvent based on glycol, and the drying roller is made of a polyurethane foam.

The invention also provides a cleaning system for implementing the method, and a postage meter incorporating such a system. The invention further provides a ready-to-install cleaning set or "kit" comprising the cleaning roller and optionally the drying roller.

BRIEF DESCRIPTION OF THE DRAWINGS

Other characteristics and advantages of the present invention appear more clearly from the following description given by way of non-limiting example and with reference to the accompanying drawings, in which.

DETAILED DESCRIPTION OF A PREFERRED EMBODIMENT

Figure 1:
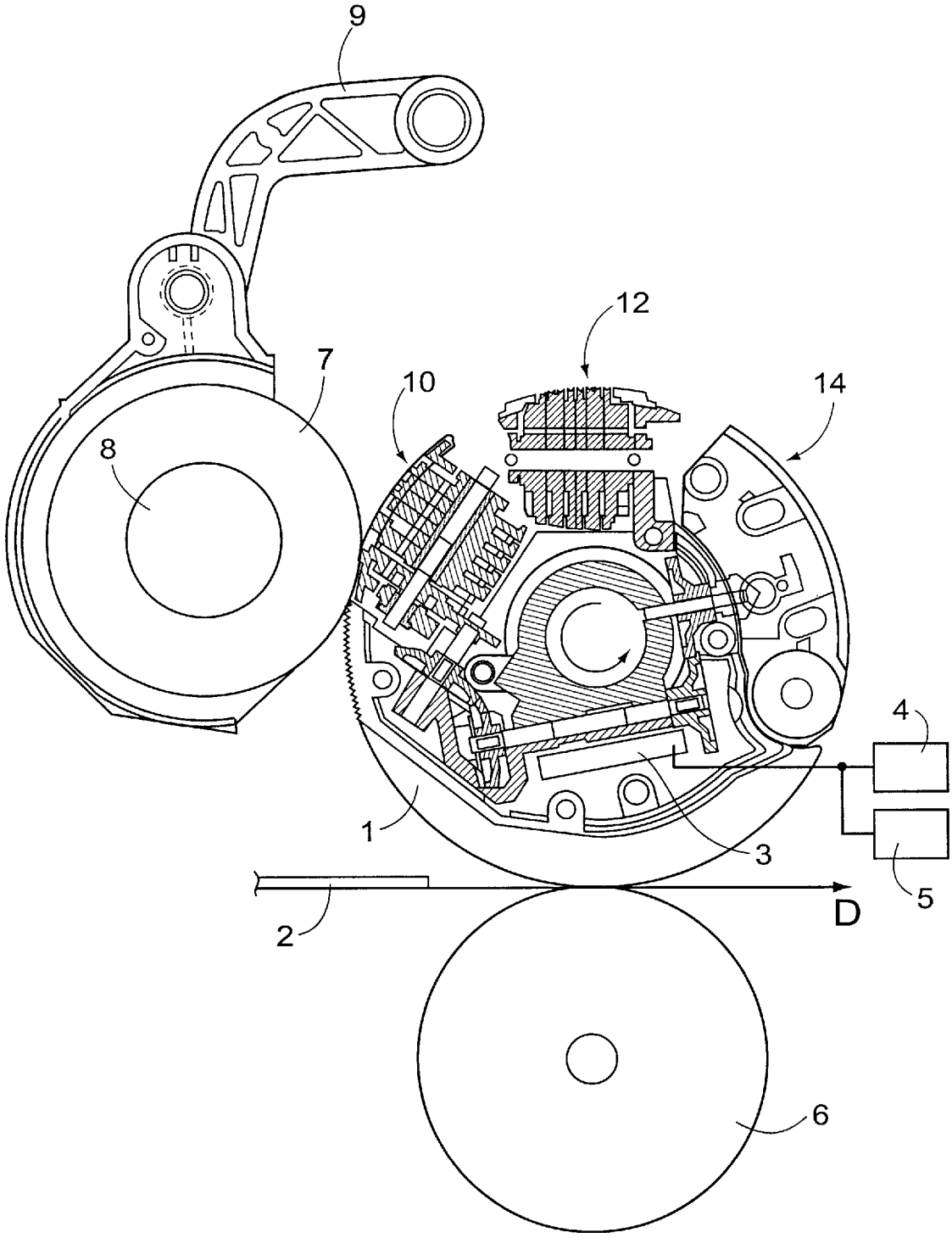
FIG. 1 shows a print head of a postage meter, the print head being designed to receive cleaning rollers of the invention.

FIG. 1 shows a rotary drum forming a print head 1 and provided with engraved printing surfaces mounted about a longitudinal axis of the drum and necessary for printing a postage imprint on a mail item 2. First print wheels 10 enable a postage value to be printed, second print wheels 12 enable a current date to be printed, and one or more printing plates 14 enable an advertising slogan or logo to be printed. An additional set of print wheels may also be provided for printing a symbol representing a particular type of carrier for the mail item, as described in the Applicant's Patent Document U.S. Pat. No. 5,524,536. Naturally, electronic control means 3, in general having a microprocessor, are present at the print head to rotate the print wheels as a function of internal data (e.g. clock data delivered by a date clock), or as a function of external data (e.g. the postage value in the absence of integrated postage-weighing scales) as entered via a control keyboard 4 for controlling the postage meter. Such data can be checked on a centralized screen 5 of the postage meter.

The print head 1 acts conventionally against a print platen roller 6, the mail item 2 being guided between these two elements by conveyor means (not shown) in a displacement direction indicated by arrow D. The print wheels and the print plate 10 to 14 are inked by means of an inking roller 7 mounted on a pin 8 of an inking support 9 which can be moved towards and away from the print head 1 by means of a control arm 10 actuated by the microprocessor control means 3. The density of the inking may be adjusted by varying the depth to which the inking roller penetrates into the engraved printing surfaces, with this adjustment being made by means of electronic control accessible via the keyboard 4.

In the invention, at least one cleaning roller is mounted in place of the inking roller 7, and software means are provided at the microprocessor 3 to enable the print head 1 to be cleaned during a determined semiautomatic maintenance cycle. This cycle is performed periodically, e.g. during the monthly visits conducted by a technician from the after-sales maintenance service for the purpose of servicing the postage meter. The dimensions of the cleaning roller are compatible with the dimensions of the inking support 9 and with its holding pin 8, so that the cleaning roller can be mounted in place of the inking roller. Advantageously, the cleaning roller is made of a polyurethane foam impregnated with a cleaning solvent, e.g. based on glycol.

The various steps of the cleaning cycle are described below with reference to FIG. 2 which is a flow chart showing how a postage meter operates during this particular cycle.

In a first step 100, the maintenance technician enters a personal identity code on the control keyboard of the postage meter so as to access the special maintenance functions of the meter, which functions are then displayed on the centralized monitor screen of the meter. In a following step 102, the technician uses the keyboard to select the "head cleaning" menu displayed on the screen (it may be noted that this selection can also be performed directly on the screen if the screen is of the touch-sensitive type). The following two messages: "Start cleaning cycle" and "Install cleaning roller" then appear on the screen in a step 104 instructing the technician to replace the inking roller with the cleaning roller. The technician does so in a following step 106. Once the cleaning roller has been installed and is in contact with the print head, the print head motor is actuated so that, in a step 108, the print head is rotated through a determined number of revolutions, e.g. fifty, with each of the print wheels being positioned at a reference value, e.g. zero. In order to access the gaps between the wheels, the step 108 is advantageously followed by a step 110, in which, with the print head then remaining stationary, each of the first print wheels corresponding to postage value is actuated in turn for a determined duration, e.g. five seconds. Then, in a subsequent step 112, the same operation is performed on the second print wheels corresponding to the current date, each of the second print wheels also being actuated in turn for a determined duration, e.g. five seconds (naturally, this step is also performed for any additional wheels when the print head includes such wheels). In a following step 114, the following two messages are displayed on the monitor screen: "Remove cleaning roller" and "End of cleaning cycle", so as to instruct the technician to remove the cleaning roller and to replace it with the inking roller. The cleaning cycle is terminated once the inking roller has been put back into place in a step 116, and the technician can then, if so desired, perform other maintenance operations, or else return to the main memory which is accessible to the user of the postage meter.

In order to increase the effect of the cleaning roller, the cycle may include a step in which inking density is set to a maximum value once said cleaning roller is installed, with the density setting being returned to a minimum value at the end of the cleaning cycle. Adjusting density causes the cleaning roller to be displaced so as to vary the depth to which it penetrates into the engraved printing surfaces.

Figure 2:
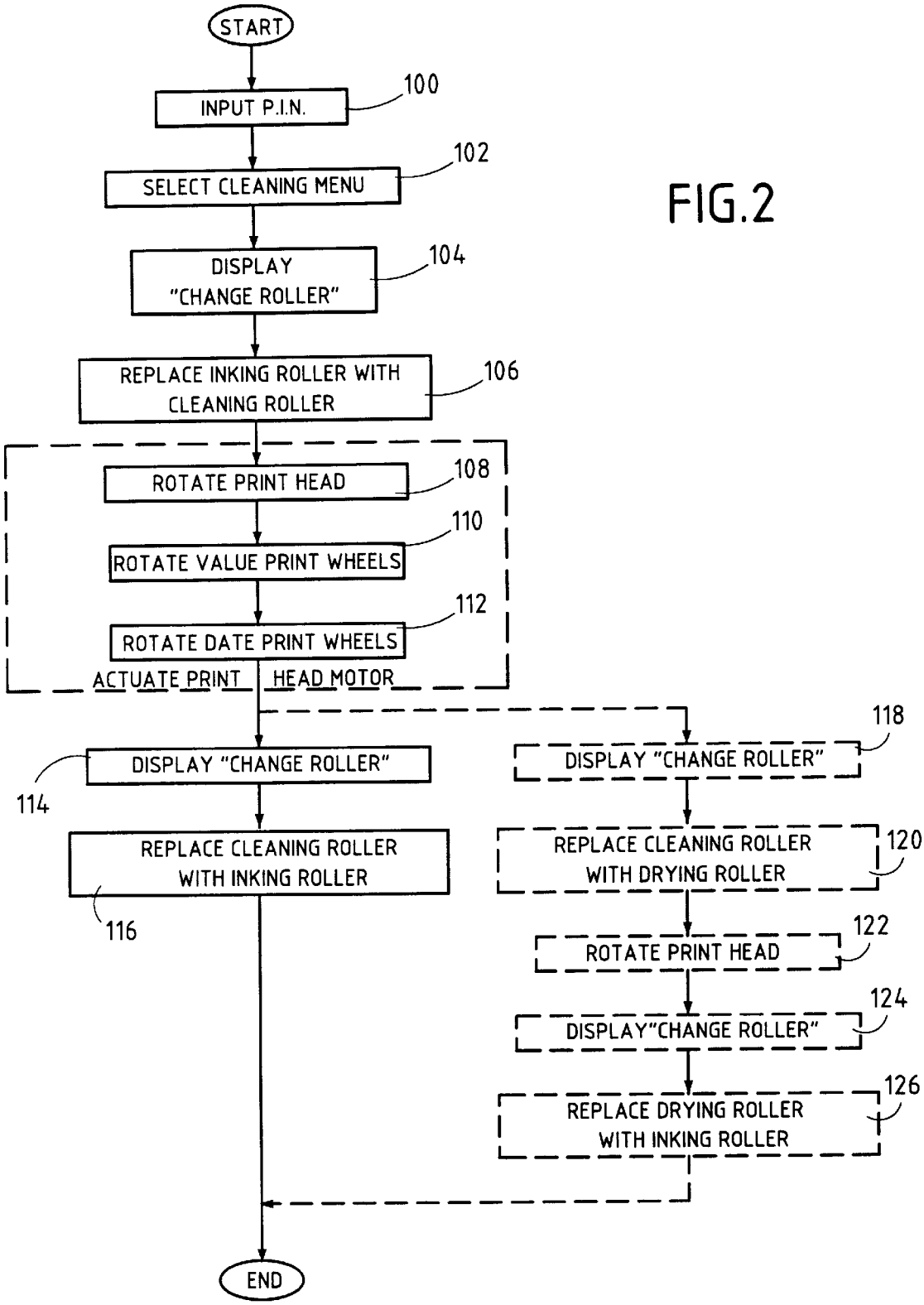
FIG. 2 is a flow chart explaining how the cleaning rollers are used.

FIG. 2 also shows, in dashed lines, a variant of the cleaning cycle in which an additional drying roller is used. Depending on the type of solvent used, and depending on the frequency of the cleaning cycles, it may be necessary to use a drying roller in addition to the cleaning roller. The dimensions of the drying roller are also compatible with the dimensions of the inking roller and its holding pin. Advantageously, the drying roller is constituted merely by a piece of polyurethane foam. The cleaning cycle is then modified as follows. Step 112 is followed by a step 118 in which the following two messages are displayed on the monitor screen: "Remove cleaning roller" and "Install drying roller", so as to instruct the technician to remove the cleaning roller and to replace it with the drying roller. The technician does so in a following step 120. Once the drying roller is installed, the print head is actuated in a step 122 so as to rotate it through a determined number of revolutions, e.g. fifty, with each of the print wheels being positioned at zero. After this rotation, the following two messages are displayed in a step 124: "Remove drying roller" and "End of cleaning cycle", so as to instruct the technician to remove the drying roller and to replace with the inking roller. The cleaning cycle then terminates once the inking roller has been put back into place in a final step 126, and the technician can, as above, perform other maintenance operations, or else return to the main menu that is accessible to the user of the postage meter.

In practice, a full cleaning cycle can be performed in less than fifteen minutes. It can be observed that the cleaning cycle does not require any special disassembly tools to be used, nor does it require any cleaning substances to be handled, such handling sometimes being dangerous. Above all, the cleaning cycle makes it possible to avoid disassembling the print head and therefore to avoid having it checked subsequently by the postal authorities. Maintenance is particularly simple because the technician merely needs a ready-to-use cleaning kit comprising the cleaning roller and optionally the drying roller, the dimensions of these rollers naturally matching the dimensions of the inking roller of the postage meter on which maintenance is to be performed.

I claim:

1. A method of cleaning a print head of a postage meter of the type having a rotary drum, said print head (1) being provided with a set of engraved printing surfaces, which set has at least first print wheels (10) for printing a postage value and second print wheels (12) for printing a current date, and said postage meter including an inking support (9) on which an inking roller (7) is mounted for the purpose of inking the print head, said method comprising the following steps:

replacing the inking roller with the cleaning roller;

actuating the motor of the print head for a determined duration; and at the end of said determined duration, placing the inking roller back into place after the cleaning roller has been removed.

2. A method according to claim 1, wherein said actuating step comprises rotating the print head through a predetermined number of revolutions.

3. A method according to claim 2, wherein said rotating step comprises rotating the print head while each of the print wheels of the head is positioned at a reference value.

4. A method according to claim 3, further comprising the step of rotating each of the print wheels in succession after the print head has been rotated, with the print head remaining stationary.

5. A method according to claim 4, wherein each of the print wheels is rotated in turn for a predetermined duration.

6. A method according to claim 1, further comprising the step of, prior to said placing step replacing the cleaning roller with a drying roller; and rotating the print head through a predetermined number of revolutions.

7. A cleaning system for a postage meter including a rotary drum, a print head (1) provided with a set of engraved printing surfaces, which set has at least first print wheels (10) for printing a postage value and second print wheels (12) for printing a current date, and an inking support (9) on which an inking roller (7) is mounted for the purpose of inking the print head, said system comprising:

a cleaning roller mounted in place of the inking roller (7) so as to be put into contact with the print head; and actuating means (3) for actuating the motor of the print head in a determined cleaning cycle.

8. A cleaning system according to claim 7, wherein said cleaning roller is made of a polyurethane foam pre-impregnated with a cleaning solvent based on glycol.

9. A cleaning system according to claim 7, further comprising a drying roller mounted in place of the inking roller (4) at the end of said determined cleaning cycle.

10. A cleaning system according to claim 9, wherein the drying roller is made of a polyurethane form.

11. A postage meter including a cleaning system according to claim 7.

12. A ready-to-use cleaning kit for a postage meter including a rotary drum, a print head (1) and an inking support (9) on which an inking roller (7) is mounted for the purpose of inking the print head, said cleaning kit comprising a cleaning roller mounted in place of the inking roller so as to be put into contact with the print head.

13. A ready-to-use cleaning kit according to claim 12, wherein said cleaning roller is made of a polyurethane form pre-impregnated with a cleaning solvent based on glycol.

14. A ready-to-use cleaning kit according to claim 12 or claim 13, further comprising a drying roller mounted in place of the inking roller so as to be put into contact with the print head.

15. A ready-to-use cleaning kit according to claim 14, wherein said drying roller is made of a polyurethane foam.

* * * * *